US010870945B2

(12) United States Patent
Huang et al.

(10) Patent No.: US 10,870,945 B2
(45) Date of Patent: Dec. 22, 2020

(54) STEAM SPRAY HEAD AND STEAM IRONING MACHINE

(71) Applicant: Guangdong Shunde Highspot Technology Co., Ltd, Guangdong (CN)

(72) Inventors: Shengwan Huang, Guangdong (CN); Qijin Fan, Guangdong (CN); Haiyang Zhang, Guangdong (CN)

(73) Assignee: Guangdong Shunde Highspot Technology Co., Ltd, Foshan (CN)

( * ) Notice: Subject to any disclaimer, the term of this patent is extended or adjusted under 35 U.S.C. 154(b) by 86 days.

(21) Appl. No.: 16/252,548

(22) Filed: Jan. 18, 2019

(65) Prior Publication Data

US 2019/0360146 A1 Nov. 28, 2019

(30) Foreign Application Priority Data

May 27, 2018 (CN) ..... 2018 1 0518040

(51) Int. Cl.
*D06F 75/20* (2006.01)

(52) U.S. Cl.
CPC ..... *D06F 75/20* (2013.01)

(58) Field of Classification Search
CPC ..... D06F 75/14; D06F 75/18; D06F 75/20; D06F 75/30; D06F 87/00; D06C 7/00; F22B 37/00; F22B 37/26
See application file for complete search history.

(56) References Cited

U.S. PATENT DOCUMENTS 1,629,553 A * 5/1927 Swenson ..... D06F 75/06 38/77.6
3,258,578 A * 6/1966 Ferris ..... F24H 1/00 392/404
3,395,469 A * 8/1968 Gilbert ..... D06F 75/30 38/69
3,620,055 A * 11/1971 Blachly et al. ..... D06F 75/30 68/222
3,733,723 A * 5/1973 Takakuwa ..... D06F 75/30 38/69
4,196,340 A * 4/1980 Evans, Jr. ..... D06F 75/14 219/245
4,532,411 A * 7/1985 Terraillon ..... D06F 75/20 219/228

FOREIGN PATENT DOCUMENTS

JP 2017213106 A * 12/2017

* cited by examiner

*Primary Examiner* — Ismael Izaguirre

(57) ABSTRACT

A steam spray head includes a main body and a panel fixedly connected with the main body. The panel is provided with multiple steam orifices, and the main body is provided with a cavity, a cover plate sealing the cavity and provided with a water inlet pipe and a heating element fixed at the bottom of the cavity. The panel is provided with a first chamber communicating with the steam orifices, and an opening of the first chamber is sealed by lateral walls of the main body. One side of the main body provided with the panel is provided with a steam passage communicating the cavity with the first chamber, and multiple steam jet tubes, each end of which extends into the first chamber and presses against a corresponding steam orifice to interface with the latter, and the other end of which communicates with the cavity of the main body.

16 Claims, 3 Drawing Sheets

STEAM SPRAY HEAD AND STEAM IRONING MACHINE

CROSS REFERENCE TO RELATED APPLICATIONS

This application is based upon and claims priority to Chinese Patent Application No. 201810518040.3, filed on May 27, 2018, the entire contents of which are incorporated herein by reference.

TECHNICAL FIELD

The disclosure relates to the technical field of steam ironing machines, and in particular, to a steam spray head and a steam ironing machine.

BACKGROUND

A steam spray head of an existing steam ironing machine includes a main body and a panel. The panel is provided with several steam jet tubes, and the main body is provided with a cavity, a cover plate sealing the cavity and a heating element fixed at the bottom of the cavity. Steam generated in the main body is jetted directly from the several steam jet tubes to iron a garment. When the steam is jetted directly from the several steam jet tubes, a part of condensated water will be carried by the steam and also jetted from the steam jet tubes. The condensated water falling on the garment will seriously affect the quality of ironing. Furthermore, in the above arrangement, ironing is performed only through the steam jetted from the steam jet tubes, and the panel with an enough high temperature will also affect the quality of ironing.

SUMMARY

In order to overcome the disadvantages in the existing techniques, the disclosure is intended to provide a steam spray head that can effectively prevent condensated water from being jetted and increase the temperature of the panel.

To this end, according to one aspect of the disclosure, there is provided a steam spray head, including a main body and a panel fixedly connected with the main body, the panel being provided with a plurality of steam orifices, and the main body being provided with a cavity, a cover plate sealing the cavity and provided with a water inlet pipe and a heating element, wherein the panel is provided with a first chamber, a side of the main body is provided with a steam passage and a plurality of steam jet tubes, the panel is positioned at the side of the main body provided with the steam passage and the plurality of steam jet tubes, and lateral walls of the main body seal an opening of the first chamber; one end of the steam passage communicates with the cavity of the main body, and the other end of the steam passage communicates with the first chamber; and one end of each of the plurality of steam jet tubes extends into the first chamber and presses against a corresponding steam orifice to interface with the steam orifice, and the other end of each of the plurality of steam jet tubes communicates with the cavity of the main body.

According to an embodiment of the disclosure, a sealing element is provided between all steam jet tubes and the steam orifices, and the sealing element is provided with a steam hole at a position corresponding to each of the plurality of steam jet tubes.

According to an embodiment of the disclosure, the sealing element is covered on all the steam jet tubes.

According to an embodiment of the disclosure, the cross section of the sealing element is U-shaped.

According to an embodiment of the disclosure, the first chamber is provided with a second chamber mating with the sealing element, and the sealing element is embedded into the second chamber.

According to an embodiment of the disclosure, the first chamber is formed by a first raised wall extending upwards on one side of the panel, and the second chamber is formed by a second raised wall extending upwards on said one side of the panel.

According to an embodiment of the disclosure, the main body is provided with a fitting groove mating with the first raised wall, the first raised wall being received into the fitting groove.

According to an embodiment of the disclosure, the cavity is provided with a plurality of flaps isolating the cavity into a plurality of vaporization chambers, and each of the plurality of flaps is provided with a steam guiding port.

According to an embodiment of the disclosure, a sealing ring is provided between the main body and the cover plate.

According to another aspect of the disclosure, there is also provided a steam ironing machine providing with any of the aforementioned steam spray head.

Compared with existing techniques, the disclosure has beneficial effects as follows.

Firstly, according to some embodiments of the disclosure, the panel is provided with a first chamber communicating with the steam orifices, and one side of the main body is provided with a steam passage communicating with the first chamber and several steam jet tubes extending into the first chamber and pressing against respective steam orifices to communicate with the steam orifices. In this way, steam entering the first chamber through the steam passage heats the panel so that the temperature of the panel remains at about 140° C., thus a temperature controller is not needed to control the temperature to prevent a garment from being damaged due to an excessively high temperature of the panel. Furthermore, the garment is ironed by the steam jetted from the steam jet tubes in combination with the panel heated to and remains at an appropriate temperature, thereby greatly improving the quality of ironing.

Secondly, according to some embodiments of the disclosure, the steam orifices are located within the first chamber, and surfaces around the steam orifices are all heated faces. Thus, when a garment is ironed, temperatures of positions around the steam orifices on the panel, which contact with the garment, are uniform so that the quality of ironing can be guaranteed.

Thirdly, according to some embodiments of the disclosure, the steam jet tubes are provided in the main body, and extend into the first chamber and press against respective steam orifices to communicate with the steam orifices. Vaporized high-temperature steam from the cavity is directly jetted through the spray head, thus it is possible to reduce heat loss during transferring of the steam, thereby reducing energy consumption.

LIST OF REFERENCE SIGNS

Figure 1:
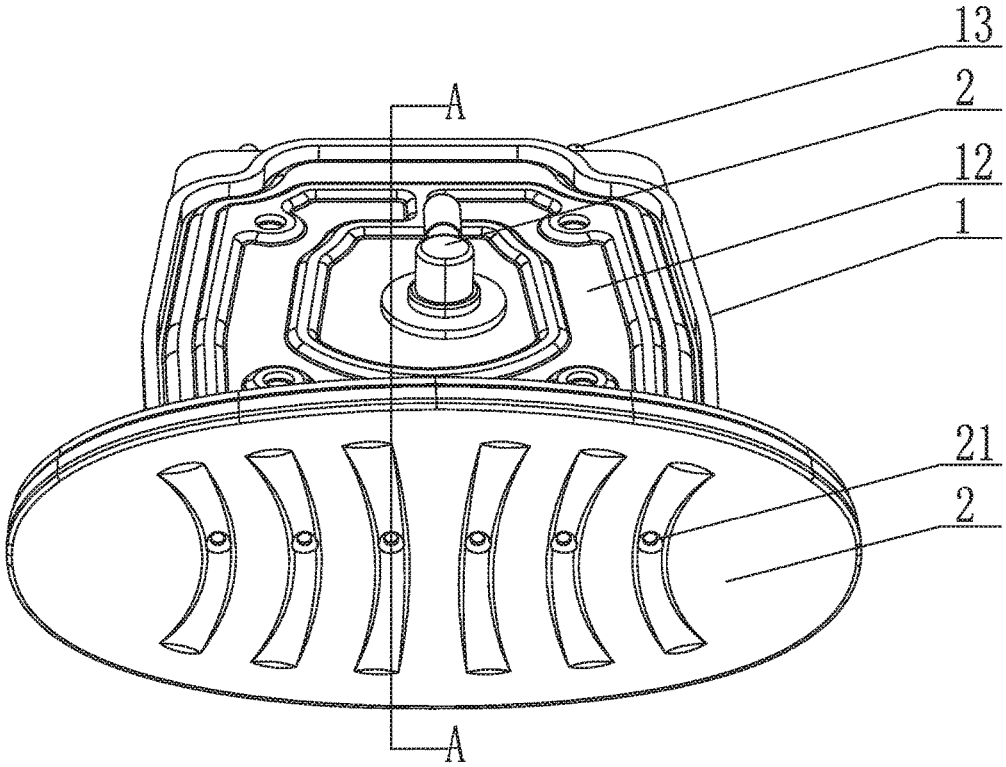
FIG. 1 is a perspective view of a steam spray head according to an embodiment of the disclosure.

1 main body
11 cavity
111 vaporization chamber
12 cover plate
121 water inlet pipe
13 heating element
14 steam passage
15 steam jet tubes
16 sealing element
17 fitting groove
2 panel
21 steam orifices
22 first chamber
23 second chamber
24 first raised wall
25 second raised wall
3 sealing ring

DETAILED DESCRIPTION

The disclosure will be further elaborated in specific embodiments in combination with the drawings.

Figure 2:
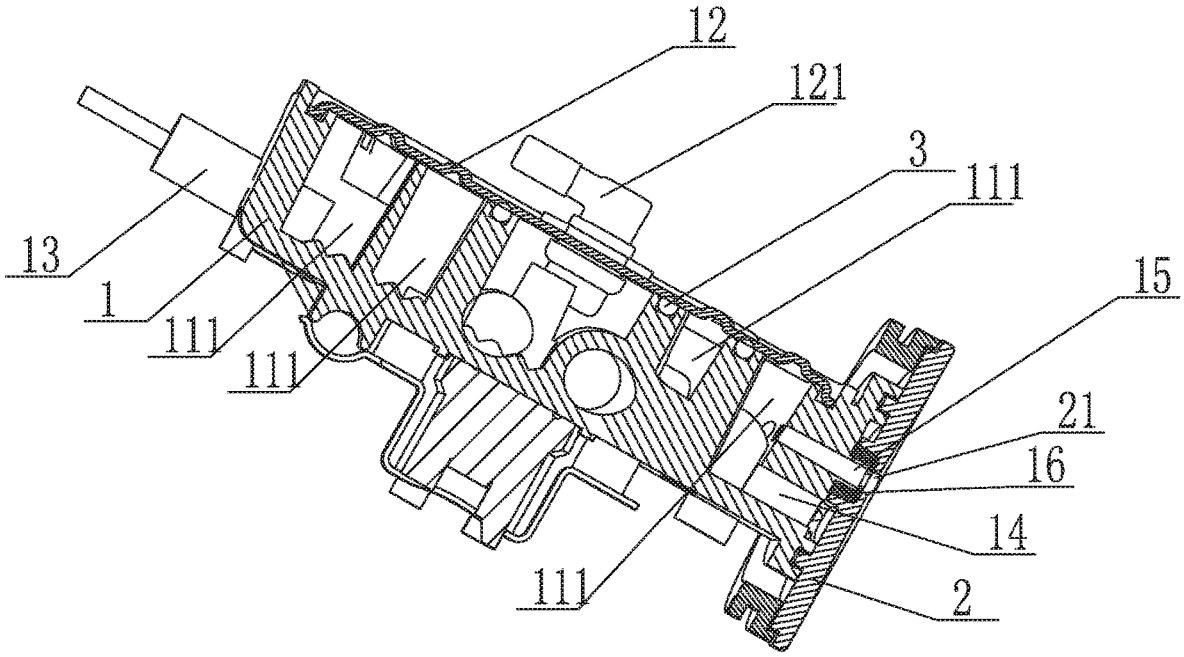
FIG. 2 is a cross-sectional view along A-A direction of the steam spray head in FIG. 1.
Figure 3:
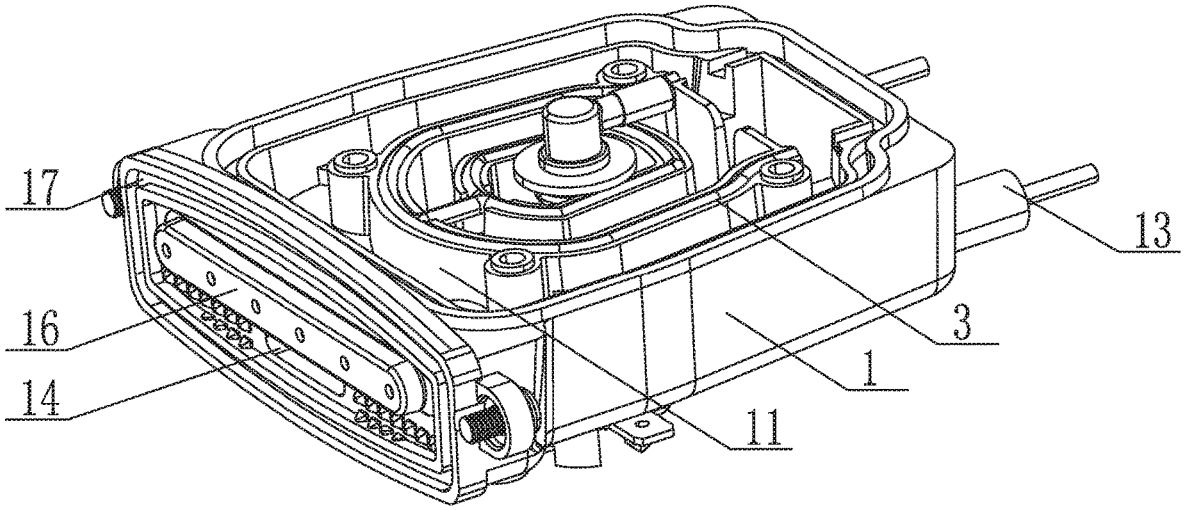
FIG. 3 is a perspective view of the steam spray head in FIG. 1 with its panel and cover plate being removed.
Figure 4:
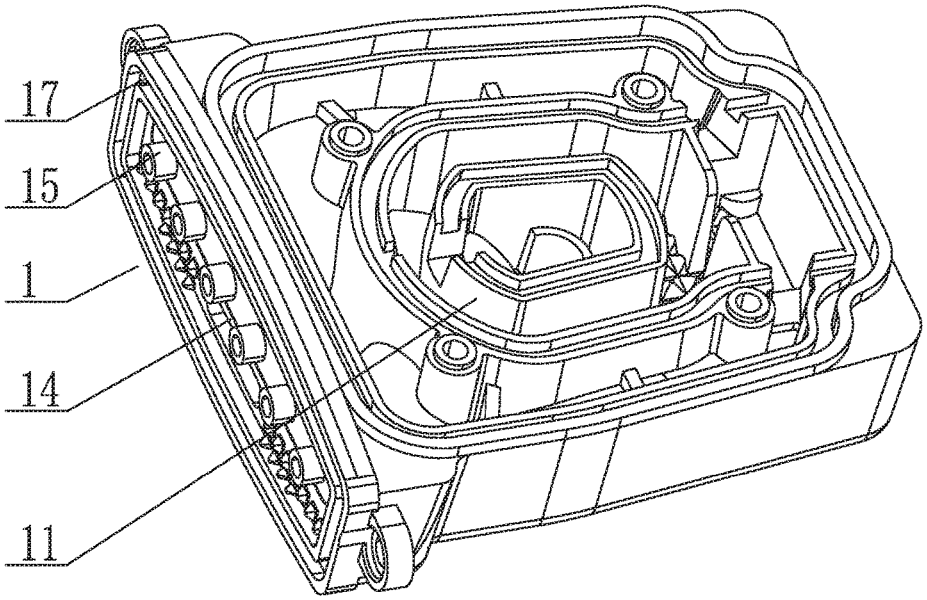
FIG. 4 is a perspective view of the steam spray head in FIG. 3 with its sealing element being removed.
Figure 5:
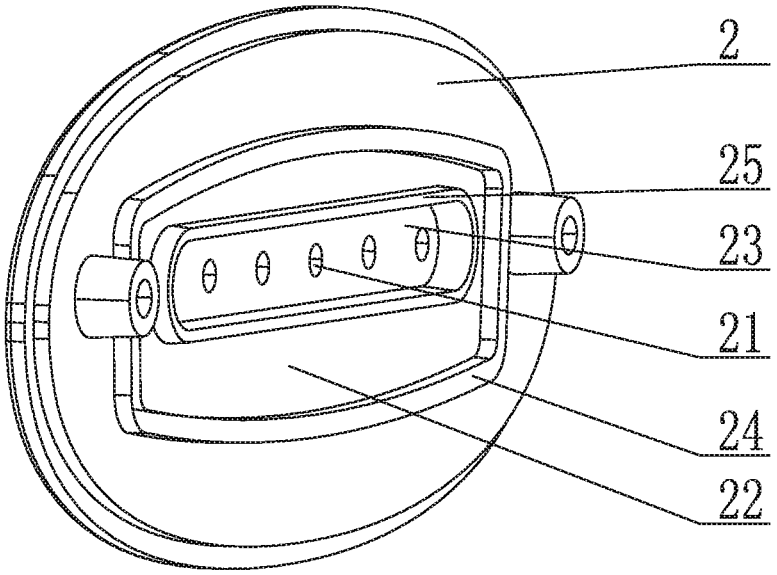
FIG. 5 is a perspective view of a panel.

As shown in FIG. 1 to FIG. 5, the steam spray head according to an embodiment of the disclosure includes a main body 1 and a panel 2 fixedly connected with the main body 1. The panel 2 is provided with a first chamber 22 and multiple steam orifices 21 provided in the middle of the first chamber 22. The main body 1 is provided with a cavity 11, a cover plate 12 sealing the cavity 11 and provided with a water inlet pipe 121 and a heating element 13 fixed at the bottom of the cavity 11. A side of the main body 1 is provided with a steam passage 14 and multiple steam jet tubes 15 located above the steam passage 14. The panel 2 is positioned at the side of the main body provided with the steam passage 14 and the multiple steam jet tubes 15, and lateral walls of the main body 1 seal an opening of the first chamber 22; one end of the steam passage 14 communicates the first chamber 22, and the other end of the steam passage 14 communicates with the cavity 11 of the main body 1. And one end of each of the multiple steam jet tubes 15 extends into the first chamber 22 and presses against a corresponding steam orifice 21 to interface with the steam orifice 21, and the other end of each of the multiple steam jet tubes 15 communicates with the cavity 11 of the main body 1.

Preferably, a sealing element is provided between the steam jet tubes 15 and the steam orifices, and the sealing element 16 is provided with a steam hole at a position corresponding to each of the steam jet tubes 15. The sealing element 16 may further strengthen the leak-tightness between the steam jet tubes 15 and the steam orifices 21, and may effectively prevent the steam in the first chamber 22 from being jetted from the steam orifices 21.

Preferably, the cross section of the sealing element 16 is U-shaped. The sealing element 16 is covered on all steam jet tubes 21. The sealing element 16 covered on the steam jet tubes 21 can not only facilitate fitting, but also has a simple structure that can simplify the manufacturing process.

Preferably, the first chamber 22 is provided with a second chamber 23 mating with the sealing element 16, and the sealing element 16 is embedded into the second chamber 23. The second chamber 23 is used for positioning, and can make the steam orifices 21 and the first chamber 22 sealed more tightly.

Preferably, the first chamber 22 is formed by a first raised wall 24 extending upwards on one side of the panel 2, and the second chamber 23 is formed by a second raised wall 25 extending upwards on said one side of the panel 2. Thus, it is convenient to process and reduce processing difficulty.

Preferably, the main body 1 is provided with a fitting groove 17 mating with the first raised wall 24, and the first raised wall 24 is received into the fitting groove 17. The fitting groove 17 may be used for positioning during fitting of the panel 2 and the main body 1, and may be used for sealing the first chamber 22.

Preferably, the cavity 11 is provided with multiple flaps isolating the cavity 11 into multiple vaporization chambers 111, and each of the flaps is provided with a steam guiding port so that water circulates in the cavity 11 and is vaporised efficiently.

Preferably, a sealing ring 3 is provided between the main body 1 and the cover plate 12 to make the main body 1 and the cover plate 12 sealed tightly.

The steam spray head according to embodiments of the disclosure operates as follows. Cold water enters the vaporization chambers 111 of the cavity 11 through the water inlet pipe 121 of the cover plate 12. The heating element 13 heats the water in the vaporization chambers 111 so that the water is vaporized into high-temperature steam in the vaporization chambers 111. A part of the steam enters t he first chamber 22 through the steam passage 14 to heat the panel 2 so that the temperature of the panel 2 is maintained at about 140° C., thus a temperature controller is not needed to control the temperature to prevent a garment from being damaged due to an excessively high temperature of the panel. The other part of the steam enters the steam jet tubes 15 and is jetted from the steam orifices 21 to iron the garment. In this way, the garment is ironed by the steam jetted from the steam jet tubes 15 in combination with the panel 2 heated by the steam, thereby greatly improving the quality of ironing.

There is also provided a steam ironing machine providing with any of the aforementioned steam spray head.

According to the disclosure and teaching above, those skilled in the art can alter and modify the above embodiments. Thus, the disclosure is not limited to the specific embodiment disclosed and described above. The modifications and alterations of these embodiments fall with the scope of protection of the disclosure. Although specific terms are employed herein, they are used in a generic and descriptive sense only and not for purposes of limitation.

The invention claimed is:

1. A steam spray head, comprising a main body and a panel fixedly connected with the main body, the panel being provided with a plurality of steam orifices, and the main body being provided with a cavity, a cover plate sealing the cavity and provided with a water inlet pipe and a heating element, wherein the panel is provided with a first chamber, a side of the main body is provided with a steam passage and a plurality of steam jet tubes, the panel is positioned at the side of the main body provided with the steam passage and the plurality of steam jet tubes, and lateral walls of the main body seal an opening of the first chamber; one end of the steam passage communicates with the cavity of the main body, and the other end of the steam passage communicates with the first chamber; and one end of each of the plurality of steam jet tubes extends into the first chamber and presses against a corresponding steam orifice to interface with the steam orifice, and the other end of each of the plurality of steam jet tubes communicates with the cavity of the main body; the sealing element is covered on the steam jet tubes.

2. The steam spray head according to claim 1, wherein a sealing element is provided between all steam jet tubes and the steam orifices, and the sealing element is provided with a steam hole at a position corresponding to each of the plurality of steam jet tubes.

3. The steam spray head according to claim 1, wherein a cross section of the sealing element is U-shaped.

4. The steam spray head according to claim 3, wherein the first chamber is provided with a second chamber mating with the sealing element, and the sealing element is embedded into the second chamber.

5. The steam spray head according to claim 4, wherein the first chamber is formed by a first raised wall extending upwards on one side of the panel, and the second chamber is formed by a second raised wall extending upwards on said one side of the panel.

6. The steam spray head according to claim 5, wherein the main body is provided with a fitting groove mating with the first raised wall, the first raised wall being received into the fitting groove.

7. The steam spray head according to claim 1, wherein the cavity is provided with a plurality of flaps isolating the cavity into a plurality of vaporization chambers, and each of the plurality of flaps is provided with a steam guiding port.

8. The steam spray head according to claim 1, wherein a seal ring is provided between the main body and the cover plate.

9. A steam ironing machine providing with a steam spray head, wherein the steam spray head comprises a main body and a panel fixedly connected with the main body, the panel being provided with a plurality of steam orifices, and the main body being provided with a cavity, a cover plate sealing the cavity and provided with a water inlet pipe and a heating element, wherein the panel is provided with a first chamber, a side of the main body is provided with a steam passage and a plurality of steam jet tubes, the panel is positioned at the side of the main body provided with the steam passage and the plurality of steam jet tubes, and lateral walls of the main body seal an opening of the first chamber; one end of the steam passage communicates with the cavity of the main body, and the other end of the steam passage communicates with the first chamber; and one end of each of the plurality of steam jet tubes extends into the first chamber and presses against a corresponding steam orifice to interface with the steam orifice, and the other end of each of the plurality of steam jet tubes communicates with the cavity of the main body; the sealing element is covered on the steam jet tubes.

10. The steam ironing machine according to claim 9, wherein a sealing element is provided between all steam jet tubes and the steam orifices, and the sealing element is provided with a steam hole at a position corresponding to each of the plurality of steam jet tubes.

11. The steam ironing machine according to claim 9, wherein a cross section of the sealing element is U-shaped.

12. The steam ironing machine according to claim 11, wherein the first chamber is provided with a second chamber mating with the sealing element, and the sealing element is embedded into the second chamber.

13. The steam ironing machine according to claim 12, wherein the first chamber is formed by a first raised wall extending upwards on one side of the panel, and the second chamber is formed by a second raised wall extending upwards on said one side of the panel.

14. The steam ironing machine according to claim 13, wherein the main body is provided with a fitting groove mating with the first raised wall, the first raised wall being received into the fitting groove.

15. The steam ironing machine according to claim 9, wherein the cavity is provided with a plurality of flaps isolating the cavity into a plurality of vaporization chambers, and each of the plurality of flaps is provided with a steam guiding port.

16. The steam ironing machine according to claim 9, wherein a seal ring is provided between the main body and the cover plate.

* * * * *